US007812241B2

(12) United States Patent
Ellis

(10) Patent No.: US 7,812,241 B2
(45) Date of Patent: Oct. 12, 2010

(54) METHODS AND SYSTEMS FOR IDENTIFYING SIMILAR SONGS

(75) Inventor: Daniel P. W. Ellis, New York, NY (US)

(73) Assignee: The Trustees of Columbia University in the City of New York, New York, NY (US)

( * ) Notice: Subject to any disclaimer, the term of this patent is extended or adjusted under 35 U.S.C. 154(b) by 0 days.

(21) Appl. No.: 11/863,014

(22) Filed: Sep. 27, 2007

(65) Prior Publication Data

US 2008/0072741 A1 Mar. 27, 2008

Related U.S. Application Data

(60) Provisional application No. 60/847,529, filed on Sep. 27, 2006.

(51) Int. Cl.
*G10H 7/00* (2006.01)

(52) U.S. Cl. ..... 84/612; 84/636

(58) Field of Classification Search ..... 84/612, 84/636

See application file for complete search history.

(56) References Cited

U.S. PATENT DOCUMENTS

| | | | | |
|---|---|---|---|---|
| 7,221,902 | B2 * | 5/2007 | Kopra et al. | 455/3.05 |
| 7,516,074 | B2 * | 4/2009 | Bilobrov | 704/270 |
| 2002/0037083 | A1 * | 3/2002 | Weare et al. | 381/58 |
| 2005/0092165 | A1 * | 5/2005 | Weare et al. | 84/668 |
| 2006/0004753 | A1 | 1/2006 | Coifman | |
| 2006/0107823 | A1 * | 5/2006 | Platt et al. | 84/616 |
| 2006/0155751 | A1 | 7/2006 | Geshwind | |
| 2006/0173692 | A1 * | 8/2006 | Rao et al. | 704/503 |
| 2007/0169613 | A1 * | 7/2007 | Kim et al. | 84/609 |
| 2007/0192087 | A1 * | 8/2007 | Kim et al. | 704/200.1 |
| 2007/0214133 | A1 | 9/2007 | Liberty | |
| 2007/0276733 | A1 * | 11/2007 | Geshwind et al. | 705/14 |

OTHER PUBLICATIONS

Bartsch, M. A. et al., "To catch a chorus: Using chroma-based representations for audio thumbnailing", In Proc. IEEE Workshop on Applications of Signal Processing to Audio and Acoustics, Oct. 2001, Mohonk, New York.

Charpentier, F J., "Pitch detection using the short-term phase spectrum", In Proc. ICASSP-86, 1986, pp. 113-116, Tokyo.

(Continued)

*Primary Examiner*—Jeffrey Donels
(74) *Attorney, Agent, or Firm*—Byrne Poh LLP

(57) ABSTRACT

Methods and systems for identifying similar songs are provided. In accordance with some embodiments, methods for identifying similar songs are provided, the methods comprising: identifying beats in at least a portion of a song; generating beat-level descriptors of the at least a portion of the song corresponding to the beats; comparing the beat-level descriptors to other beat-level descriptors corresponding to a plurality of songs. In accordance with some embodiments, systems for identifying similar songs are provided, the systems comprising: a digital processing device that: identifies beats in at least a portion of a song; generates beat-level descriptors of the at least a portion of the song corresponding to the beats; and compares the beat-level descriptors to other beat-level descriptors corresponding to a plurality of songs.

17 Claims, 10 Drawing Sheets

OTHER PUBLICATIONS

Fujishima, T., "Realtime chord recognition of musical sound: A system using common lisp music", In Proc. ICMC, 1999, pp. 464-467, Beijing.

Jehan, T., "Creating Music by Listening", 2005, MIT Media Lab, Cambridge, MA.

Maddage, N. C. et al., "Content-based music structure analysis with applications to music semantics understanding", In Proc. ACM MultiMedia, 2004, pp. 112-119, New York, NY.

T. Abe and M. Honda. Sinusoidal model based on instantaneous frequency attractors. IEEE Tr. Audio, Speech and Lang. Proc., 14(4):1292-1300,2006.

M. Casey and M. Slaney. The importance of sequences in musical similarity. In Proc. ICASSP-06, pp. V-5-8, Toulouse, 2006.

E. G'omez. Tonal description of polyphonic audio for music content processing. INFORMS Journal on Computing, Special Cluster on Computation in Music, 18(3):294-304, 2006.

M. Mueller, F. Kurth, and M. Clausen. Audio matching via chroma-based statistical features. In Proc. Int. Conf. on Music Info. Retr. ISMIR-05, pp. 288-295, London, 2005.

W.-H Tsai, H.-M Yu, and H.-M. Wang. A query-by-example technique for retrieving cover versions of popular songs with similar melodies. In Proc. Int. Conf. on Music Info. Retr. ISMIR-05, pp. 183-190, London, 2005.

P. Desain and H. Honing. Computational models of beat induction: The rule-based approach. Journal of New Music Resarch, 28(1):29-42, 1999.

S. Dixon. Automatic extraction of tempo and beat from expressive performances. Journal of New Music Research, 30 (1):39-58, 2001.

S. Dixon, W. Goebl, and E. Cambouropoulos. Perceptual smoothness of tempo in expressively performed music. Journal of New Music Resarch, 23(3):195-214, 2006.

M. Goto and Y. Muraoka. A beat tracking system for acoustic signals of music. In Proceedings of ACM Multimedia, pp. 365-372, San Francisco, CA, 1994.

F. Gouyon, A. Klapuri, S. Dixon, M. Alonso, G. Tzanetakis, C. Uhle, and P. Cano. An experimental comparison of audio tempo induction algorithms. IEEE Transactions on Speech and Audio Processing, 14(5):1832-1844, 2006.

A. Klapuri. Sound onset detection by applying psychoacoustic knowledge. In Proceedings of the IEEE International Conference on Acoustics, Speech, and Signal Processing, pp. 3089-3092, Phoenix, AZ, 1999.

J. Laroche. Efficient tempo and beat tracking in audio recordings. Journal of the Audio Engineering Society, 51(4):226-233, Apr. 2003.

M. F. McKinney and D. Moelants. Audio Tempo Extraction from MIREX 2005.

M. F. McKinney and D. Moelants. Audio Beat Tracking from MIREX 2006.

M. F. McKinney, D. Moelants, M. Davies, and A. Klapuri. Evaluation of audio beat tracking and music tempo extraction algorithms. Journal of New Music Research, 2007.

Martin F. McKinney and Dirk Moelants. Ambiguity in tempo perception: What draws listeners to different metrical levels?, Music Perception, 24(2):155-166, 2006.

D. Moelants and M. F. McKinney. Tempo perception and musical content: What makes a piece fast, slow, or temporally ambiguous? in S. D. Lipscomb, R. Ashley, R. O. Gjerdingen, and P. Webster, editors, Proceedings of the 8th International Conference on Music Perception and Cognition, pp. 558-562, Evanston, IL, 2004.

G. Peeters. Template-based estimation of time-varying tempo. EURASIP Journal on Advances in Signal Processing, 2007(Article ID 67215):14 pages, 2007.

J.-J. Aucouturier and F. Pachet, "Music similarity measures: What's the use?," in Proc. 3rd International Symposium on Music Information Retrieval ISMIR, Paris, 2002.

M. I. Mandel and D. P. W. Ellis, "Song-level features and support vector machines for music classification," in Proc. International Conference on Music Information Retrieval ISMIR, London, Sep. 2005, pp. 594-599.

J. Downie, K. West, A. Ehmann, and E. Vincent, "The 2005 Music Information Retrieval Evaluation eXchange (MIREX 2005): Preliminary overview," in Proceedings of the International Conference on Music Information Retrieval, London, 2005, pp. 320-323.

A. A. Gruzd, J. S. Downie, M. C. Jones, and J. H. Lee, "Evalutron 6000: collecting music relevance judgments," in Proc. Joint Conference on Digital Libraries (JCDL), Vancouver, BC, 2007, p. 507.

S. Chen and P. Gopalakrishnan, "Speaker, environment and channel change detection and clustering via the bayesian information in criterion," in Proc. DARPA Broadcast News Transcription and Understanding Workshop, 1998.

M. I. Mandel and D. P.W. Ellis, "A web-based game for collecting music metadata," in Proc. International Conference on Music Information Retrieval ISMIR, Vienna, 2007.

A. Rauber, E. Pampalk, and D. Merkl, "Using psychoacoustic models and self-organizing maps to create a hierarchical structuring of music by sound similarities," in Proc. Int. Symposium on Music Information Retrieval (ISMIR), Paris, 2002.

B. Logan, "Mel Frequency Cepstral Coefficients for Music Modeling," In Int'l Symposium on Music Info Retrieval, 2000.

U.S. Appl. No. 60/582,242, Jun. 23, 2004.

U.S. Appl. No. 60/610,841, Sep. 17, 2004.

U.S. Appl. No. 60/697,069, Jul. 5, 2005.

U.S. Appl. No. 60/799,973, May 12, 2006.

U.S. Appl. No. 60/799,974, May 12, 2006.

U.S. Appl. No. 60/811,692, Jun. 7, 2006.

U.S. Appl. No. 60/811,713, Jun. 7, 2006.

U.S. Appl. No. 60/855,716, Oct. 31, 2006.

B. Logan, "A Content-Based Music Similarity Function," Cambridge Research Laboratory, Compaq Computer Corporation, Jun. 2001.

* cited by examiner

METHODS AND SYSTEMS FOR IDENTIFYING SIMILAR SONGS

CROSS REFERENCE TO RELATED APPLICATION

This application claims the benefit of U.S. Provisional Patent Application No. 60/847,529, filed Sep. 27, 2006, which is hereby incorporated by reference herein in its entirety.

TECHNICAL FIELD

The disclosed subject matter relates to methods and systems for identifying similar songs.

BACKGROUND

Being able to automatically identify similar songs is a capability with many applications. For example, a music lover may desire to identify cover versions of a favorite song in order to enjoy other interpretations of that song. As another example, copyright holders may want to be able identify different versions of their songs, copies of those songs, etc. in order to insure proper copyright license revenue. As yet another example, users may want to be able to identify songs with a similar sound to a particular song. As still another example, a user listening to a song may desire to know the identity of the song or artist performing the song.

While it is generally easy for a human to identify two songs that are similar, automatically doing so with a machine is much more difficult. However, with millions of songs readily available, having humans compare songs manually is practically impossible. Thus, there is a need for mechanisms which can automatically identify similar songs.

SUMMARY

Methods and systems for identifying similar songs are provided. In accordance with some embodiments, methods for identifying similar songs are provided, the methods comprising: identifying beats in at least a portion of a song; generating beat-level descriptors of the at least a portion of the song corresponding to the beats; comparing the beat-level descriptors to other beat-level descriptors corresponding to a plurality of songs. In accordance with some embodiments, systems for identifying similar songs are provided, the systems comprising: a digital processing device that: identifies beats in at least a portion of a song; generates beat-level descriptors of the at least a portion of the song corresponding to the beats; and compares the beat-level descriptors to other beat-level descriptors corresponding to a plurality of songs.

DETAILED DESCRIPTION

In accordance with various embodiments, mechanisms for comparing songs are provided. These mechanisms can be used in a variety of applications. For example, cover songs of a song can be identified. A cover song can include a song performed by one artist after that song was previously performed by another artist. As another example, very similar songs (e.g., two songs with similar sounds, whether unintentional (e.g., due to coincidence) or intentional (e.g., in the case of sampling or copying)) can be identified. As yet another example, different songs with a common, distinctive sound can also be identified. As a still further example, a song being played can be identified (e.g., when a user is listening to the radio and wants to know the name of a song, the user can use these mechanisms to capture and identify the song).

In some embodiments, these mechanisms can receive a song or a portion of a song. For example, songs can be received from a storage device, from a microphone, or from any other suitable device or interface. Beats in the song can then be identified. By identifying beats in the song, variations in tempo between different songs can be normalized. Beat-level descriptors in the song can then be generated. These beat-level descriptors can be stored in fixed-size feature vectors for each beat to create a feature array. By comparing the sequence of beat-synchronous feature vectors for two songs, e.g., by cross-correlating the feature arrays, similar songs can be identified. The results of this identification can then be presented to a user. For example, these results can include one or more names of the closest songs to the song input to the mechanism, the likelihood that the input song is very similar to one or more other songs, etc.

Figure 1:
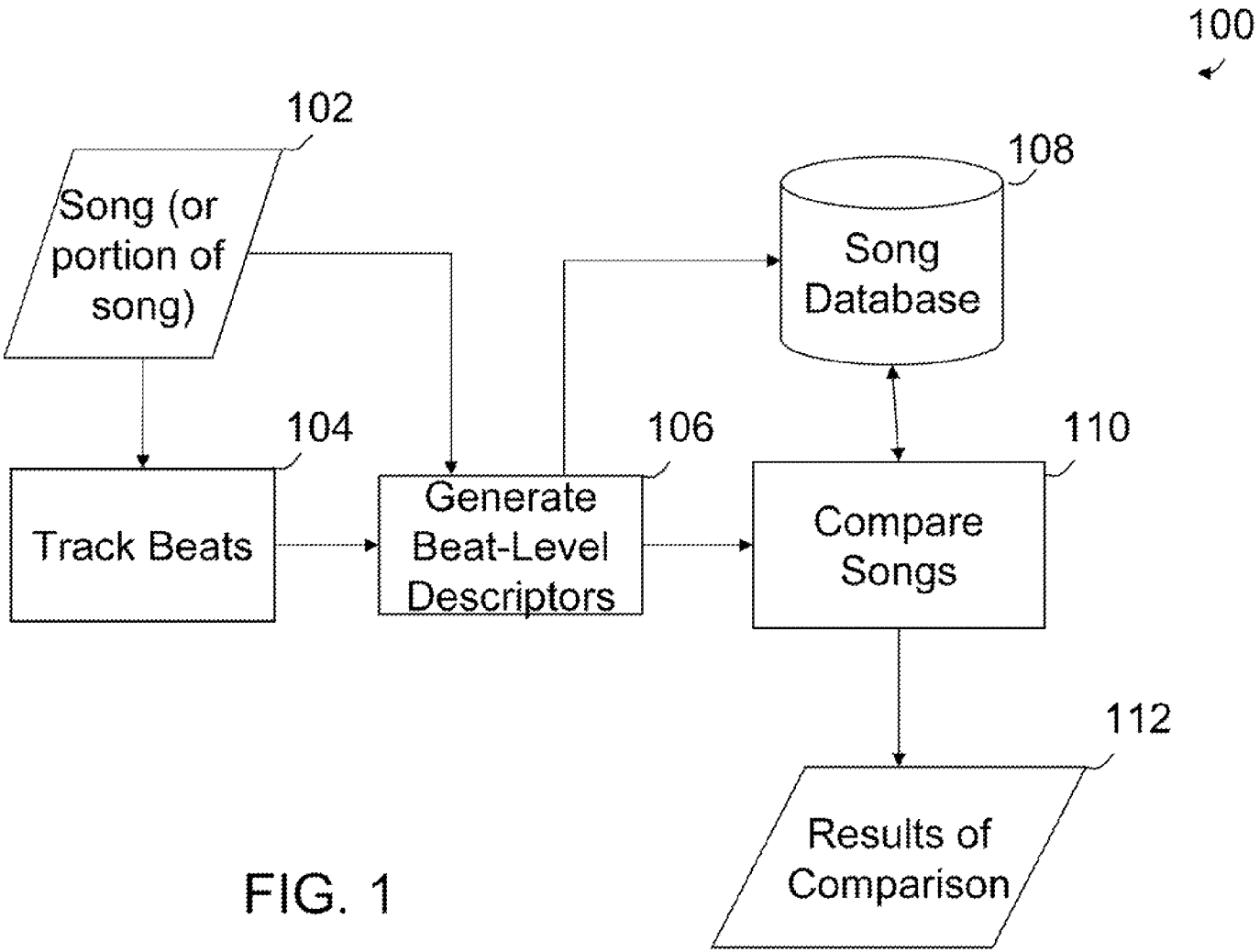
FIG. 1 is a diagram of a mechanism for identifying similar songs in accordance with some embodiments.

In accordance with some embodiments, songs (or portions of songs) can be compared using a process 100 as illustrated in FIG. 1. As shown, a song (or portion of a song) 102 can be provided to a beat tracker at 104. The beat tracker can identify beats in the song (or portion of the song). Next, at 106, beat-level descriptors for each beat in the song can be generated. These beat-level descriptors can represent the melody and harmony, or spectral shape, of a song in a way that facilitates comparison with other songs. In some embodiments, the beat-level descriptors for a song can be saved to a database 108. At 110, the beat-level descriptors for a song (or a portion of a song) can be compared to beat-level descriptors for other songs (or portions of other songs) previous saved to database 108. The results of the comparison can then be presented at 112. The results can be presented in any suitable fashion.

Figure 2:
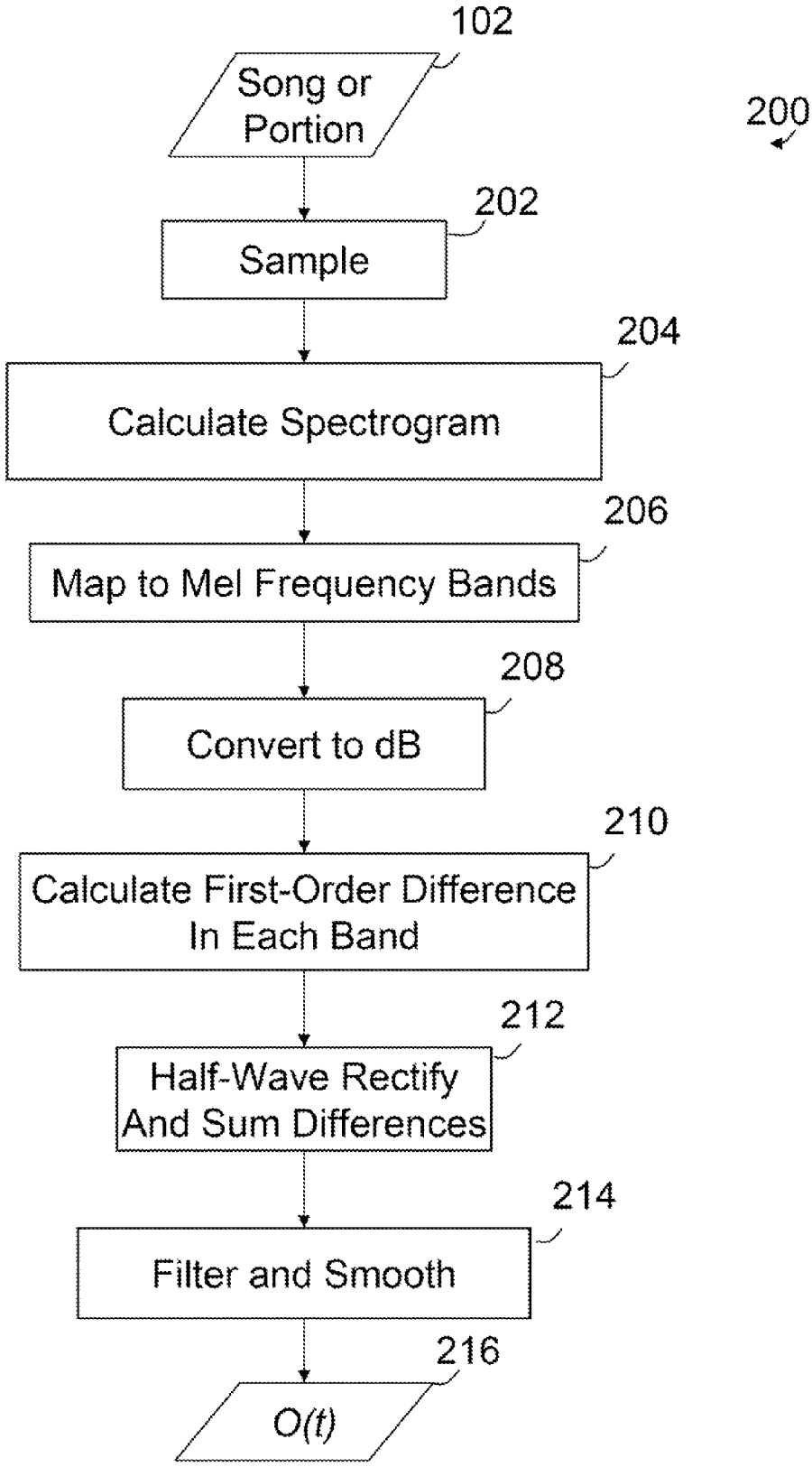
FIG. 2 is a diagram of a mechanism for creating an onset strength envelope in accordance with some embodiments.

In accordance with some embodiments, in order to track beats at 104, all or a portion of a song is converted into an onset strength envelope O(t) 216 as illustrated in process 200 in FIG. 2. As part of this process, the song (or portion of the song) 102 can be sampled or re-sampled (e.g., at 8 kHz or any other suitable rate) at 202 and then the spectrogram of the short-term Fourier transform (STFT) calculated for time intervals in the song (e.g., using 32 Ms windows and 4 ms advance between frames or any other suitable window and advance) at 204. An approximate auditory representation of the song can then be formed at 206 by mapping to 40 (or any other suitable number) Mel frequency bands to balance the perceptual importance of each frequency band. This can be accomplished, for example, by calculating each Mel bin as a weighted average of the FFT bins ranging from the center frequencies of the two adjacent Mel bins, with linear weighting to give a triangular weighting window. The Mel spectrogram can then be converted to dB at 208, and the first-order difference along time is calculated for each band at 210. Then, at 212, negative values in the first-order differences are set to zero (half-wave rectification), and the remaining, positive differences are summed across all of the frequency bands. The summed differences can then be passed through a high-pass filter (e.g., with a cutoff around 0.4 Hz) and smoothed (e.g., by convolving with a Gaussian envelope about 20 ms wide) at 214. This gives a one-dimensional onset strength envelope 216 as a function of time that responds to proportional increase in energy summed across approximately auditory frequency bands.

In some embodiments, the onset envelope for each musical excerpt can then be normalized by dividing by its standard deviation.

Figure 3:
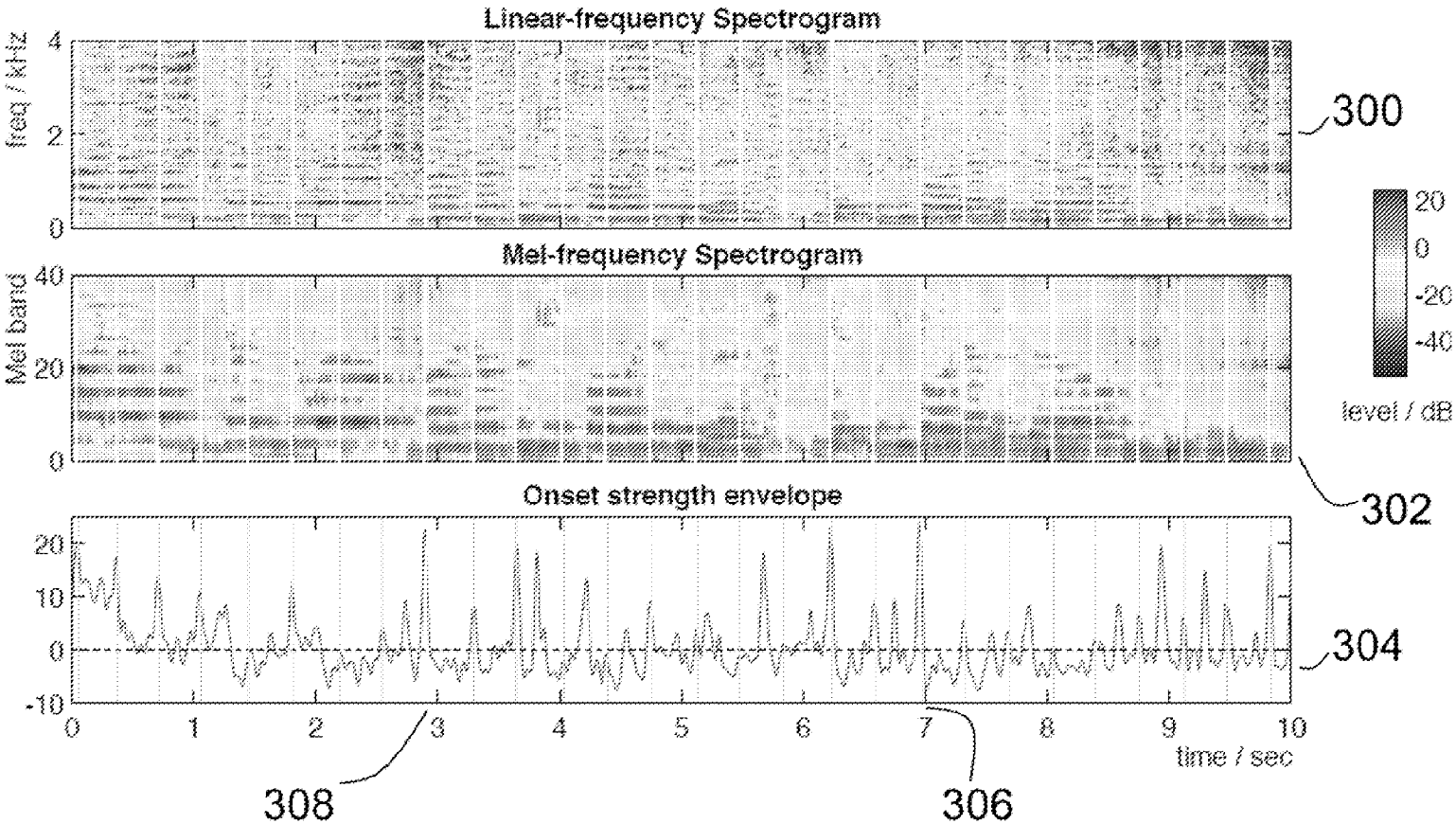
FIG. 3 is a diagram showing a linear-frequency spectrogram, a Mel-frequency spectrogram, and an onset strength envelope for a portion of a song in accordance with some embodiments.

FIG. 3 shows an example of an STFT spectrogram 300, Mel spectrogram 302, and onset strength envelope 304 for a brief example of singing plus guitar. Peaks in the onset envelope 304 correspond to times when there are significant energy onsets across multiple bands in the signal. Vertical bars 306 and 308 in the onset strength envelope 304 indicate beat times.

Figure 4:
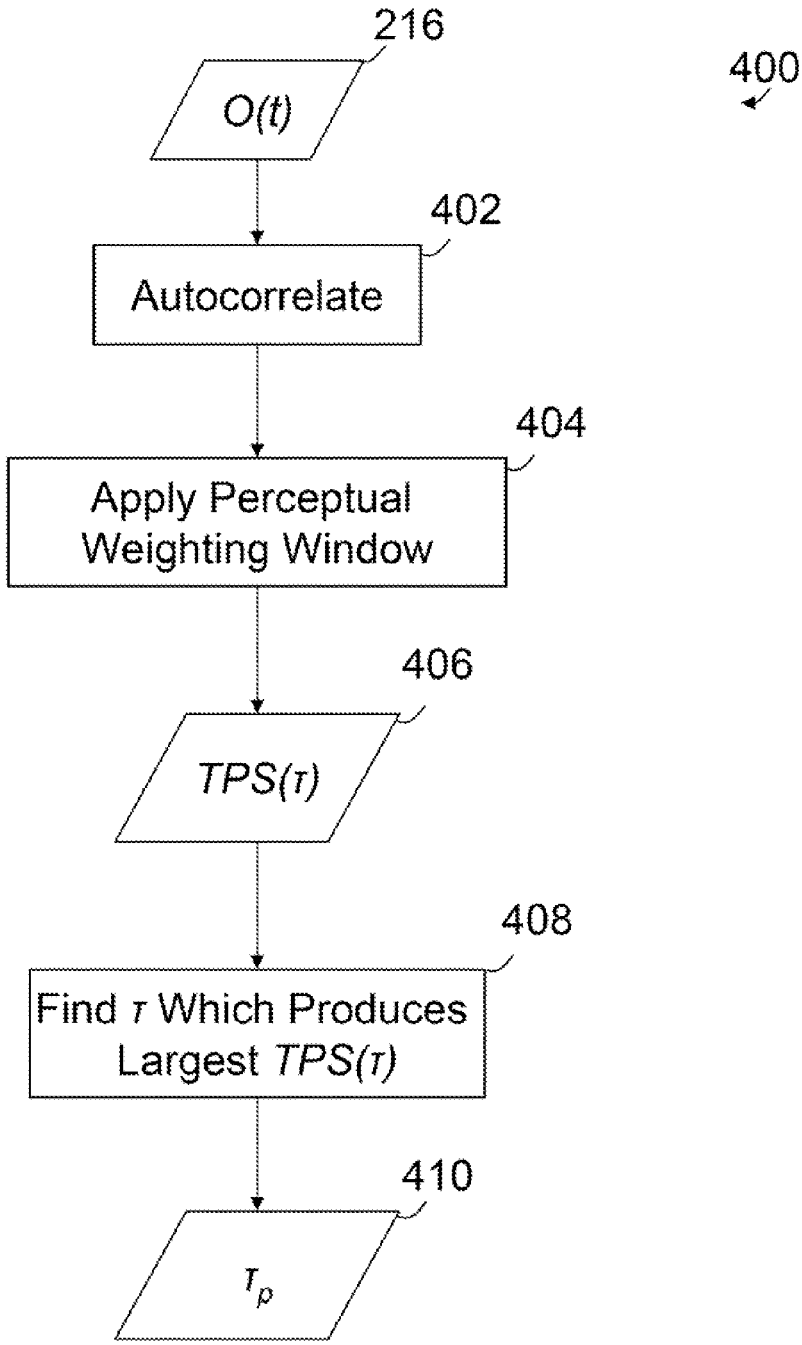
FIG. 4 is a diagram of a mechanism for identifying a primary tempo period estimate in accordance with some embodiments.

In some embodiments, a tempo estimate $\tau_p$ for the song (or portion of the song) can next be calculated using process 400 as illustrated in FIG. 4. Given an onset strength envelope O(t) 216, autocorrelation can be used to reveal any regular, periodic structure in the envelope. For example, autocorrelation can be performed at 402 to calculate the inner product of the envelope with delayed versions of itself. For delays that succeed in lining up many of the peaks, a large correlation can occur. For example, such an autocorrelation can be represented as:

$$\sum_t O(t)O(t-\tau) \tag{1}$$

Because there can be large correlations at various integer multiples of a basic period (e.g., as the peaks line up with the peaks that occur two or more beats later), it can be difficult to choose a single best peak among many correlation peaks of comparable magnitude. However, human tempo perception (as might be examined by asking subjects to tap along in time to a piece of music) is known to have a bias towards 120 beats per minute (BPM). Therefore, in some embodiments, a perceptual weighting window can be applied at 404 to the raw autocorrelation to down-weight periodicity peaks that are far from this bias. For example, such a perceptual weighting window $W(\tau)$ can be expressed as a Gaussian weighting function on a log-time axis, such as:

$$W(\tau) = \exp\left\{-\frac{1}{2}\left(\frac{\log_2 \tau/\tau_0}{\sigma_\tau}\right)^2\right\} \tag{2}$$

where $\tau_0$ is the center of the tempo period bias (e.g., 0.5 s corresponding to 120 BPM, or any other suitable value), and $\sigma_\tau$ controls the width of the weighting curve and is expressed in octaves (e.g., 1.4 octaves or any other suitable number).

By applying this perceptual weighting window $W(\tau)$ to the autocorrelation above, a tempo period strength 406 can be represented as:

$$TPS(\tau) = W(\tau)\sum_t O(t)O(t-\tau) \tag{3}$$

Tempo period strength 406, for any given period $\tau$, can be indicative of the likelihood of a human choosing that period as the underlying tempo of the input sound. A primary tempo period estimate $\tau_p$ 410 can therefore be determined at 408 by identifying the $\tau$ for which $TPS(\tau)$ is largest.

Figure 5:
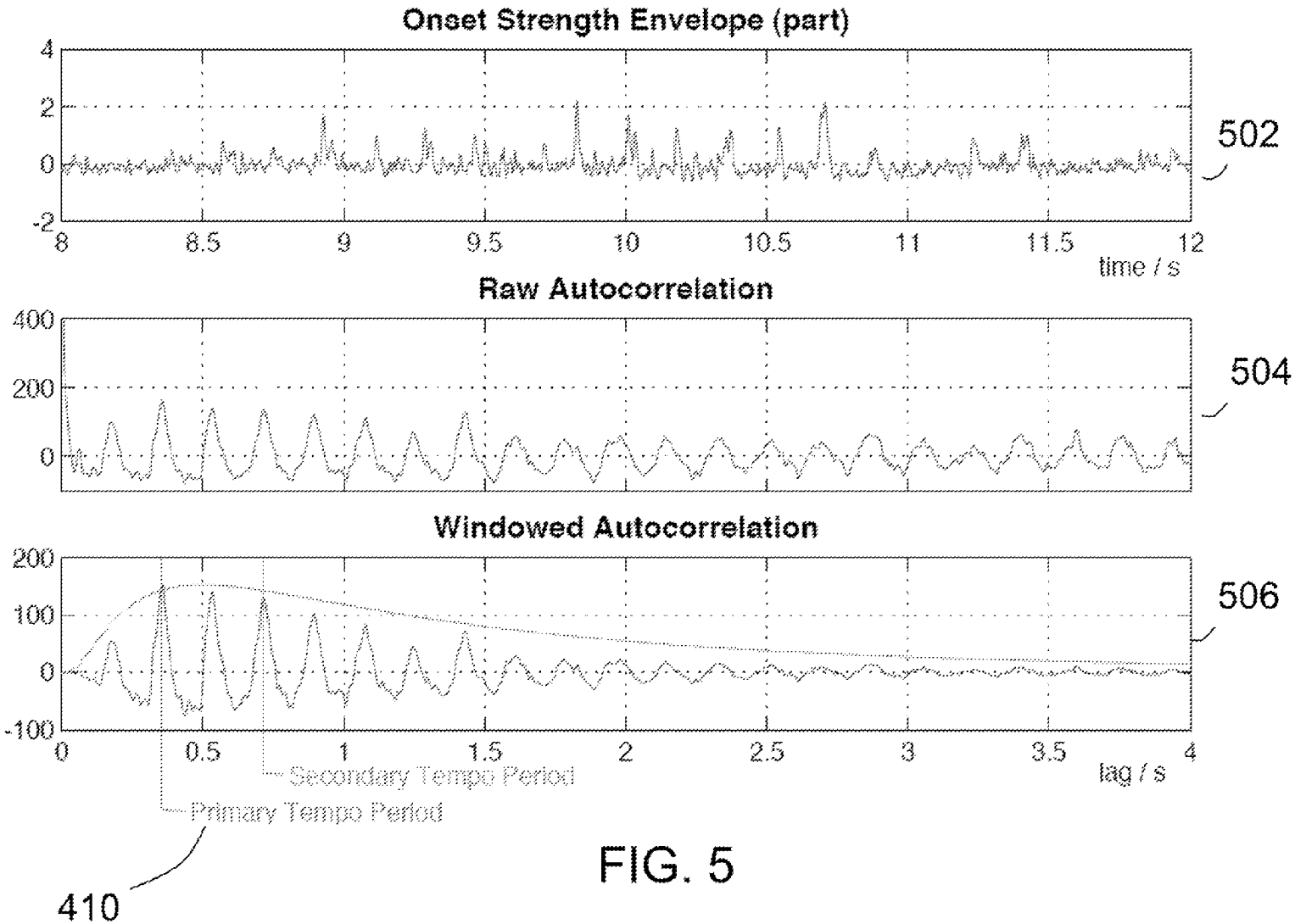
FIG. 5 is a diagram showing an onset strength envelope, a raw autocorrelation, and a windowed autocorrelation for a portion of a song in accordance with some embodiments.

FIG. 5 illustrates examples of part of an onset strength envelope 502, a raw autocorrelation 504, and a windowed autocorrelation (TPS) 506 for the example of FIG. 3. The primary tempo period estimate $\tau_p$ 410 is also illustrated.

Figure 6:
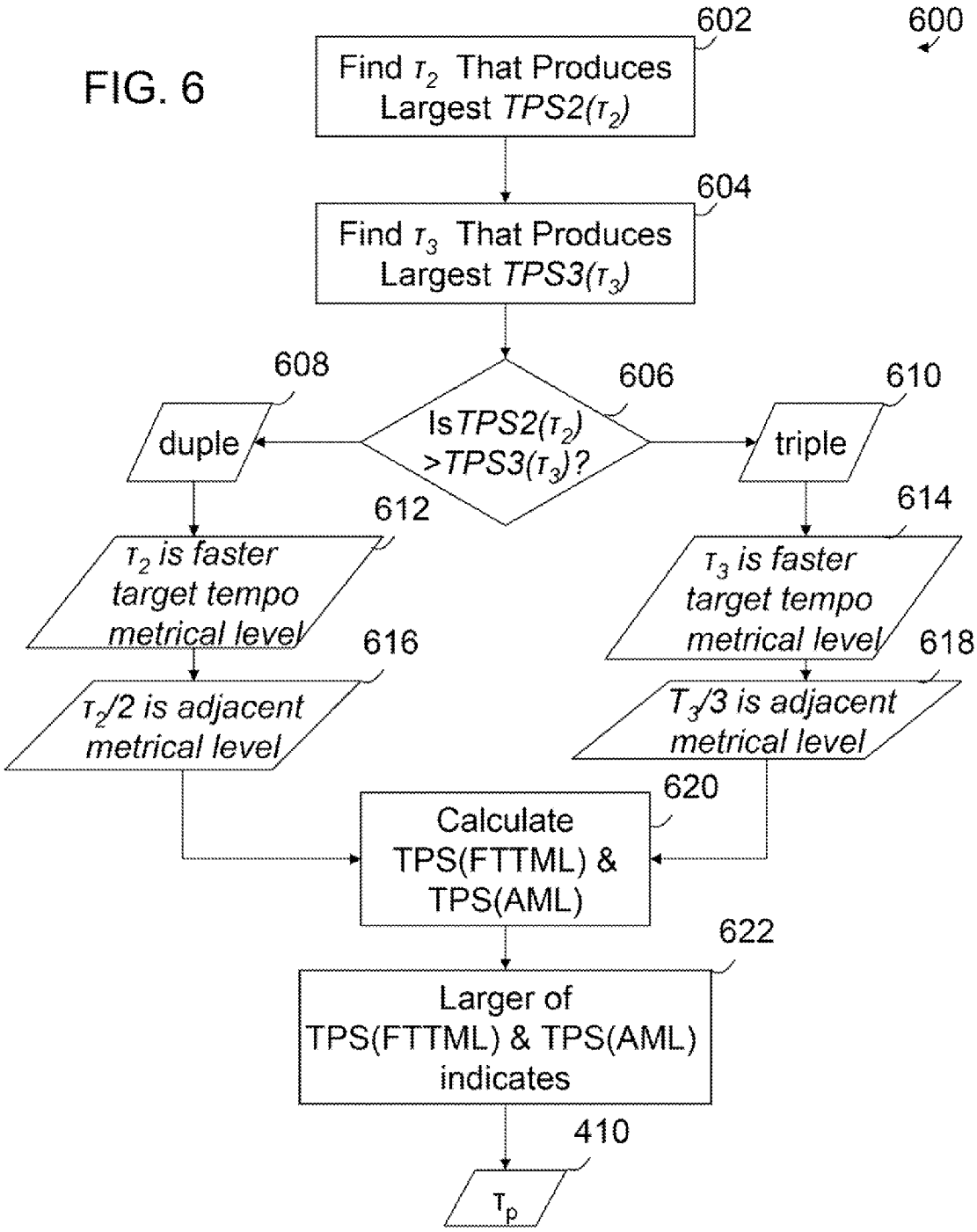
FIG. 6 is a diagram of a further mechanism for identifying a primary tempo period estimate in accordance with some embodiments.

In some embodiments, rather than simply choosing the largest peak in the base TPS, a process 600 of FIG. 6 can be used to determine $\tau_p$. As shown, two further functions can be calculated at 602 and 604 by re-sampling TPS to one-half and one-third, respectively, of its original length, adding this to the original TPS, then choosing the largest peak across both of these new sequences as shown below:

$$TPS2(\tau_2)=TPS(\tau_2)+0.5TPS(2\tau_2)+0.25TPS(2\tau_2-1)+0.25TPS(2\tau_2+1) \tag{4}$$

$$TPS3(\tau_3)=TPS(\tau_3)+0.33TPS(3\tau_3)+0.33TPS(3\tau_3-1)+0.33TPS(3\tau_3+1) \tag{5}$$

Whichever sequence (4) or (5) results in a larger peak value TPS2($\tau_2$) or TPS3($\tau_3$) determines at 606 whether the tempo is considered duple 608 or triple 610, respectively. The value of $\tau_2$ or $\tau_3$ corresponding to the larger peak value is then treated as the faster target tempo metrical level at 612 or 614, with one-half or one-third of that value as the adjacent metrical level at 616 or 618. TPS can then be calculated twice using the faster target tempo metrical level and adjacent metrical level using equation (3) at 620. In some embodiments, an $\sigma_r$ of 0.9 octaves (or any other suitable value) can be used instead of an $\sigma_r$ of 1.4 octaves in performing the calculations of equation (3). The larger value of these two TPS values can then be used at 622 to indicate that the faster target tempo metrical level or the adjacent metrical level, respectively, is the primary tempo period estimate $\tau_p$ 410.

Figure 7:
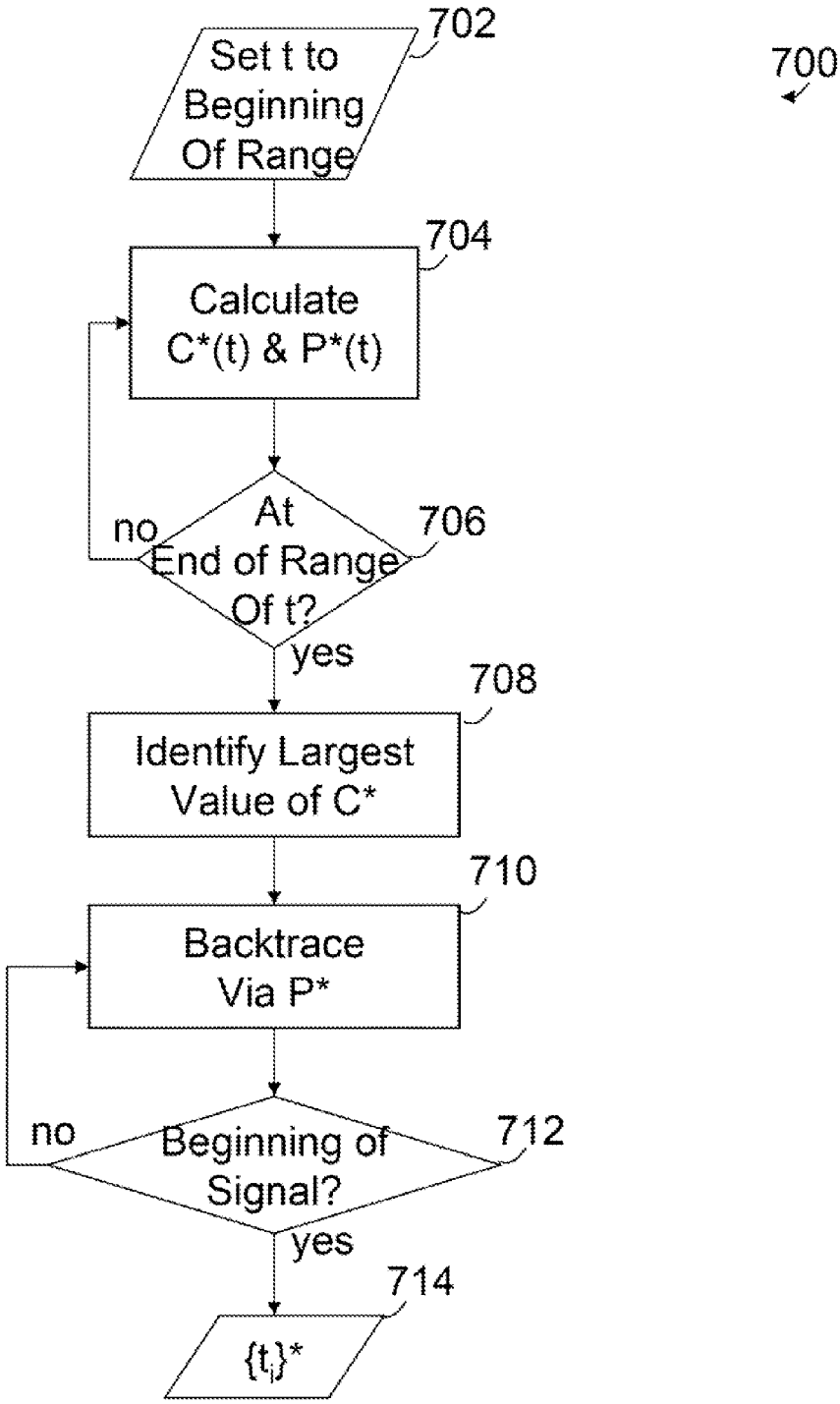
FIG. 7 is a diagram of a mechanism for identifying beats in accordance with some embodiments.

Using the onset strength envelope and the tempo estimate, a sequence of beat times that correspond to perceived onsets in the audio signal and constitute a regular, rhythmic pattern can be generated using process 700 as illustrated in connection with FIG. 7 using the following equation:

$$C(\{t_i\}) = \sum_{i=1}^{N} O(t_i) + \alpha \sum_{i=2}^{N} F(t_i - t_{i-1}, \tau_p) \tag{6}$$

where $\{t_i\}$ is the sequence of N beat instants, O(t) is the onset strength envelope, $\alpha$ is a weighting to balance the importance of the two terms (e.g., $\alpha$ can be 400 or any other suitable value), and $F(\Delta t, \tau_p)$ is a function that measures the consistency between an inter-beat interval $\Delta t$ and the ideal beat spacing $\tau_p$ defined by the target tempo. For example, a simple squared-error function applied to the log-ratio of actual and ideal time spacing can be used for $F(\Delta t, \tau_p)$:

$$F(\Delta t, \tau) = -\left(\log\frac{\Delta t}{\tau}\right)^2 \tag{7}$$

which takes a maximum value of 0 when $\Delta t=\tau$, becomes increasingly negative for larger deviations, and is symmetric on a log-time axis so that $F(k\tau,\tau)=F(\tau/k,\tau)$.

A property of the objective function C(t) is that the best-scoring time sequence can be assembled recursively to calculate the best possible score C*(t) of all sequences that end at time 1. The recursive relation can be defined as:

$$C^*(t) = O(t) + \max_{\tau=0 \ldots t-1} \{\alpha F(t-\tau, \tau_p) + C^*(\tau)\} \tag{8}$$

This equation is based on the observation that the best score for time t is the local onset strength, plus the best score to the preceding beat time $\tau$ that maximizes the sum of that best score and the transition cost from that time. While calculating C*, the actual preceding beat time that gave the best score can also be recorded as:

$$P^*(t) = \arg\max_{\tau=0 \ldots t-1} \{\alpha F(t-\tau, \tau_p) + C^*(\tau)\} \tag{9}$$

In some embodiments, a limited range of $\tau$ can be searched instead of the full range because the rapidly growing penalty term F will make it unlikely that the best predecessor time lies far from $t-\tau_p$. Thus, a search can be limited to $\tau=t-2\tau_p \ldots t-\tau/2$ as follows:

$$C^*(t) = O(t) + \max_{\tau=t-2\tau_p \ldots t-\tau_p/2} \{\alpha F(t-\tau, \tau_p) + C^*(\tau)\} \tag{8'}$$

$$P^*(t) = \arg\max_{\tau=t-2\tau_p \ldots t-\tau_p/2} \{\alpha F(t-\tau, \tau_p) + C^*(\tau)\} \tag{9'}$$

To find the set of beat times that optimize the objective function for a given onset envelope, C*(t) and P*(t) can be calculated at 704 for every time starting from the beginning of the range zero at 702 via 706. The largest value of C* (which will typically be within $\tau_p$ of the end of the time range) can be identified at 708. This largest value of C* is the final beat instant $t_N$—where N, the total number of beats, is still unknown at this point. The beats leading up to C* can be identified by 'back tracing' via P* at 710, finding the preceding beat time $t_{N-1}=P^*(t_N)$, and progressively working backwards via 712 until the beginning of the song (or portion of a song) is reached. This produces the entire optimal beat sequence $(t_i)$*714.

In order to accommodate slowly varying tempos, $\tau_p$ can be updated dynamically during the progressive calculation of C*(t) and P*(t). For instance, $\tau_p(t)$ can be set to a weighted average (e.g., so that times further in the past have progressively less weight) of the best inter-beat-intervals found in the max search for times around t. For example, as C*(t) and P*(t) are calculated at 704, $\tau_p(t)$ can be calculated as:

$$\tau_p(t)=\eta(t-P^*(t))+(1-\eta)\tau_p(P^*(t)) \tag{10}$$

where $\eta$ is a smoothing constant having a value between 0 and 1 (e.g., 0.1 or any other suitable value) that is based on how quickly the tempo can change. During the subsequent calculation of C*(t+1), the term $F(t-\tau, \tau_p)$ can be replaced with $F(t-\tau, \tau_p(\tau))$ to take into account the new local tempo estimate.

In order to accommodate several abrupt changes in tempo, several different $\tau_p$ values can be used in calculating C*( ) and P*( ) in some embodiments. In some of these embodiments, a penalty factor can be included in the calculations of C*( ) and P*( ) to down-weight calculations that favor frequent shifts between tempo. For example, a number of different tempos can be used in parallel to add a second dimension to C*( ) and P*( ) to find the best sequence ending at time t and with a particular tempo $\tau_{pi}$. For example, C*( ) and P*( ) can be represented as:

$$C^*(t, \tau_{pi}) = O(t) + \max_{\tau=0 \ldots t-1} \{\alpha F(t-\tau, \tau_{pi}) + C^*(\tau)\} \tag{8''}$$

$$P^*(t, \tau_{pi}) = \arg\max_{\tau=0 \ldots t-1} \{\alpha F(t-\tau, \tau_{pi}) + C^*(\tau)\} \tag{9''}$$

This approach is able to find an optimal spacing of beats even in intervals where there is no acoustic evidence of any beats. This "filling in" emerges naturally from the back trace and may be beneficial in cases in which music contains silence or long sustained notes.

Using the optimal beat sequence $\{t_i\}$*, the song (or a portion of the song) can next be used to generate a single feature vector per beat as beat-level descriptors, as illustrated at 106 of FIG. 1. These beat-level descriptors can be used to represent both the dominant note (typically melody) and the broad harmonic accompaniment in the song (or portion of the song) (e.g., when using chroma features as described below), or the spectral shape of the song (or portion of the song) (e.g., when using MFCCs as described below).

In some embodiments, beat-level descriptors are generated as the intensity associated with each of 12 semitones (e.g. piano keys) within an octave formed by folding all octaves together (e.g., putting the intensity of semitone A across all octaves in the same semitone bin A, putting the intensity of semitone B across all octaves in the same semitone bin B, putting the intensity of semitone C across all octaves in the same semitone bin C, etc.).

In generating these beat-level descriptors, phase-derivatives (instantaneous frequencies) of FFT bins can be used both to identify strong tonal components in the spectrum (indicated by spectrally adjacent bins with close instantaneous frequencies) and to get a higher-resolution estimate of the underlying frequency. For example, a 1024 point Fourier transform can be applied to 10 seconds of the song (or the portion of the song) sampled (or re-sampled) at 11 kHz with 93 ms overlapping windows advanced by 10 ms. This results in 513 frequency bins per FFT window and 1000 FFT windows.

To reduce these 513 frequency bins over each of 1000 windows to 12 (for example) chroma bins per beat, the 513 frequency bins can first be reduced to 12 chroma bins. This can be done by removing non-tonal peaks by keeping only bins where the instantaneous frequency is within 25% (or any other suitable value) over three (or any other suitable number) adjacent bins, estimating the frequency that each energy peak relates to from the energy peak's instantaneous frequency, applying a perceptual weighting function to the frequency estimates so frequencies closest to a given frequency (e.g., 400 Hz) have the strongest contribution to the chroma vector, and frequencies below a lower frequency (e.g., 100 Hz, 2 octaves below the given frequency, or any other suitable value) or above an upper frequency (e.g., 1600 Hz, 2 octaves above the given frequency, or any other suitable value) are strongly down-weighted, and sum up all the weighted frequency components by putting their resultant magnitude into the chroma bin with the nearest frequency.

As mentioned above, in some embodiments, each chroma bin can correspond to the same semitone in all octaves. Thus, each chroma bin can correspond to multiple frequencies (i.e., the particular semitones of the different octaves). In some embodiments, the different frequencies ($f_i$) associated with each chroma bin i can be calculated by applying the following formula to different values of r:

$$f_i = f_0 * 2^{r+(i/N)} \tag{11}$$

where $\tau$ is an integer value representing the octave relative to $f_0$ for which the specific frequency $f_i$ is to be determined (e.g., r=−1 indicates to determine $f_i$ for the octave immediately below 440 Hz), N is the total number of chroma bins (e.g., 12 in this example), and $f_0$ is the "tuning center" of the set of chroma bins (e.g. 440 Hz or any other suitable value).

Once there are 12 chroma bins over 1000 windows, in the example above, the 1000 windows can be associated with corresponding beats, and then each of the windows for a beat combined to provide a total of 12 chroma bins per beat. The windows for a beat can be combined, in some embodiments, by averaging each chroma bin i across all of the windows associated with a beat. In some embodiments, the windows for a beat can be combined by taking the largest value or the median value of each chroma bin i across all of the windows associated with a beat. In some embodiments, the windows for a beat can be combined by taking the N-th root of the average of the values, raised to the N-th power, for each chroma bin i across all of the windows associated with a beat.

In some embodiments, the Fourier transform can be weighted (e.g., using Gaussian weighting) to emphasize energy a couple of octaves (e.g., around two with a Gaussian half-width of 1 octave) above and below 400 Hz.

In some embodiments, instead of using a phase-derivative within FFT bins in order to generate beat-level descriptors as chroma bins, the STFT bins calculated in determining the onset strength envelope O(t) can be mapped directly to chroma bins by selecting spectral peaks for example, the magnitude of each FFT bin can be compared with the magnitudes of neighboring bins to determine if the bin is larger. The magnitudes of the non-larger bins can be set to zero, and a matrix containing the FFT bins multiplied by a matrix of weights that map each FFT bin to a corresponding chroma bin. This results in having 12 chroma bins per each of the FFT windows calculated in determining the onset strength envelope. These 12 bins per window can then be combined to provide 12 bins per beat in a similar manner as described above for the phase-derivative-within-FFT-bins approach to generating beat-level descriptors.

In some embodiments, the mapping of frequencies to chroma bins can be adjusted for each song (or portion of a song) by up to +0.5 semitones (or any other suitable value) by making the single strongest frequency peak from a long FFT window (e.g., 10 seconds or any other suitable value) of that song (or portion of that song) line up with a chroma bin center.

In some embodiments, the magnitude of the chroma bins can be compressed by applying a square root function to the magnitude to improve performance of the correlation between songs.

In some embodiments, each chroma bin can be normalized to have zero mean and unit variance within each dimension (i.e., the chroma bin dimension and the beat dimension). In some embodiments, the chroma bins are also high-pass filtered in the time dimension to emphasize changes. For example, a first-order high-pass filter with a 3 dB cutoff at around 0.1 radians/sample can be used.

In some embodiments, Mel-Frequency Cepstral Coefficients (MFCCs) can also be used to provide beat-level descriptors. The MFCCs can be calculated from the song (or portion of the song) by: calculating STFT magnitudes (e.g., as done in calculating the onset strength envelope); mapping each magnitude bin to a smaller number of Mel-frequency bins (e.g., this can be accomplished, for example, by calculating each Mel bin as a weighted average of the FFT bins ranging from the center frequencies of the two adjacent Mel bins, with linear weighting to give a triangular weighting window); converting the Mel spectrum to log scale; taking the discrete cosine transform (DCT) of the log-Mel spectrum; and keeping just the first N bins (e.g., 20 bins or any other suitable number) of the resulting transform. This results in 20 MFCCs per STFT window. These 20 MFCCs per window can then be combined to provide 20 MFCCs per beat in a similar manner as described above for combining the 12 chroma bins per window to provide 12 chroma bins per beat in the phase-derivative-within-FFT-bins approach to generating beat-level descriptors.

In some embodiments, the MFCC values for each beat can be high-pass filtered.

In some embodiments, in addition to the beat-level descriptors described above for each beat (e.g., 12 chroma bins or 20 MFCCs), other beat-level descriptors can additionally be generated and used in comparing songs (or portions of songs). For example, such other beat-level descriptors can include the standard deviation across the windows of beat-level descriptors within a beat, and/or the slope of a straight-line approximation to the time-sequence of values of beat-level descriptors for each window within a beat. Note, that if transposition of the chroma bins is performed as discussed below, the mechanism for doing so can be modified to insure that the chroma dimension of any matrix in which the chroma bins are stored is symmetric or to account for any asymmetry in the chroma dimension.

In some of these embodiments, only components of the song (or portion of the song) up to 1 kHz are used in forming the beat-level descriptors. In other embodiments, only components of the song (or portion of the song) up to 2 kHz are used in forming the beat-level descriptors.

Figure 8:
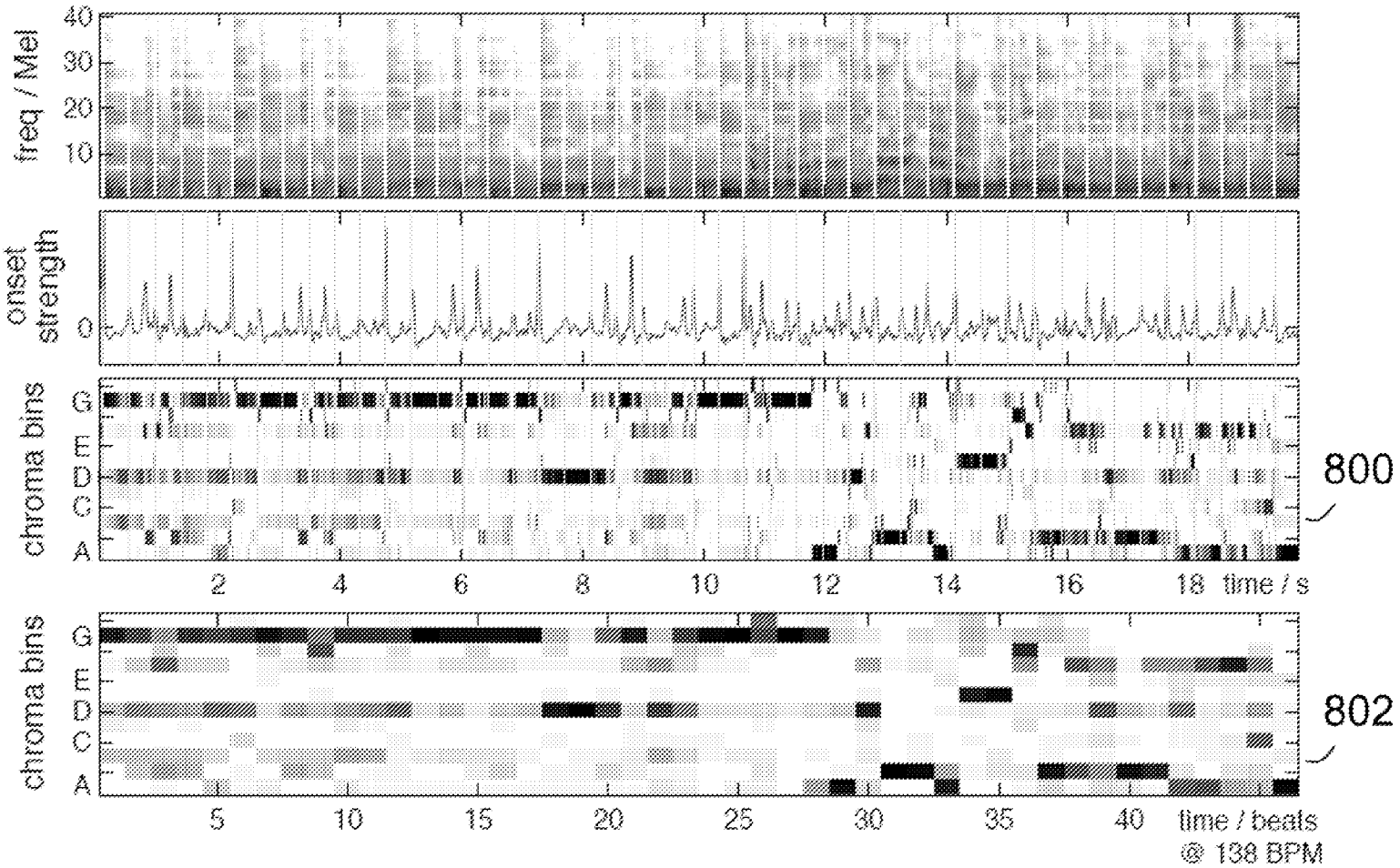
FIG. 8 is a diagram showing a Mel-frequency spectrogram, an onset strength envelope, and chroma bins for a portion of a song in accordance with some embodiments.

The lower two panes 800 and 802 of FIG. 8 show beat-level descriptors as chroma bins before and after averaging into beat-length segments.

After the beat-level descriptor processing above is completed for two or more songs (or portions of songs), those songs (or portions of songs) can be compared to determine if the songs are similar. In some embodiments, comparisons can be performed on the beat-level descriptors corresponding to specific segments of each song (or portion of a song). In some embodiments, comparisons can be performed on the beat-level descriptors corresponding to as much of the entire song (or portion of a song) that is available for comparison.

For example, comparisons can be performed using a cross-correlation of the beat-level descriptors of two songs (or portions of songs). For example, a cross correlation of beat-level descriptors can be performed using the following equation:

$$r_{xy}(\tau) = \sum_{i=0 \ldots N-1} \sum_{j=0 \ldots \max(tx,ty)} x(i, j)y(i, j-\tau) \quad (12)$$

wherein N is the number of beat-level descriptors in the beat level descriptor arrays x and y for the two songs (or portions of songs) being matched, tx and ty are the maximum time values in arrays x and y, respectively, and $\tau$ is the beat period (in seconds) being used for the primary song being examined. Similar songs (or portions of songs) can be indicated by cross-correlations of large magnitudes of r where these large magnitudes occurred in narrow local maxima that fell off rapidly as the relative alignment changed from its best value.

To emphasize these sharp local maxima, in some embodiments when the beat-level descriptors are chroma bins, transpositions of the chroma bins can be selected that give the largest peak correlation. A cross-correlation that facilitates transpositions can be represented as:

$$r_{xy}(\tau, c) = \sum_{i=0 \ldots N-1} \sum_{j=0 \ldots \max(tx,ty)} x(((i-c) \bmod N), j)y(i, j-\tau) \quad (13)$$

wherein N is the number of chroma bins in the beat level descriptor arrays x and y, tx and ty are the maximum time values in arrays x and y, respectively, c is the center chroma bin number, and $\tau$ is the beat period (in seconds) being used for the song being examined.

In some embodiments, the cross-correlation results can be normalized by dividing by the column count of the shorter matrix, so the correlation results are bounded to lie between zero and one. Additionally or alternatively, in some embodiments, the results of the cross-correlation can be high-pass filtered with a 3 dB point at 0.1 rad/sample or any other suitable filter.

In some embodiments, the cross correlation can be performed using a fast Fourier transform (FFT). This can be done by taking the FFT of the beat-level descriptors (or a portion thereof) for each song, multiplying the results of the FFTs together, and taking the inverse FFT of the product of that multiplication. In some embodiments, after the FFT of the beat-level descriptors of the song being examined is taken, the results of that FFT can be saved to a database for future comparison. Similarly, in some embodiments, rather than calculating the results of an FFT on the beat-level descriptors for a reference song, those results can be retrieved from a database.

As another example, segmentation time identification and Locality-Sensitive Hashing (LSH) can be used to perform comparisons between a song (or portion of a song) and multiple other songs. For example, segmentation time identification can be performed by fitting separate Gaussian models to the features of the beat-level descriptors in fixed-size windows on each side of every possible boundary, and selecting the boundary that gives the smallest likelihood of the features in the window on one side occurring in a Gaussian model based on the other side. As another example, segmentation time identification can be performed by computing statistics, such as mean and covariance, of windows to the left and right of each possible boundary, and selecting the boundary corresponding to the statistics that are most different. In some embodiments, the possible boundaries are the beat times for the two songs (or portions of songs). The selected boundary can subsequently be used as the reference alignment point for comparisons between the two songs (or portions of songs). In some embodiments, Locality-Sensitive Hashing (LSH), or any other suitable technique, can then be used to solve the nearest neighbor problem between the songs (or portions of songs) when focused on a window around the reference alignment point in each. In some embodiments, when one or more nearest neighbors are identified, a distance between those neighbors can be calculated to determine if those neighbors are similar.

In some embodiments, to improve correlation performance, beat-level-descriptor generation and comparisons (e.g., as described above) can be performed with any suitable multiple (e.g., double, triple, etc.) of the number of beats determined for each song (or portion of a song). For example, if song one (or a portion of song one) is determined to have a beat of 70 BPM and song two (or a portion of song two) is determined to have a beat of 65 BPM, correlations can respectively be performed for these songs at beat values of 70 and 65 BPM, 140 and 65 BPM, 70 and 130 BPM, and 140 and 130 BPM.

In some embodiments, comparison results can be further refined by comparing the tempo estimates for two or more songs (or portions of songs) being compared. For example, if a first song is similar to both a second song and a third song, the tempos between the songs can be compared to determine which pair (song one and song two, or song one and song three) is closer in tempo.

Figure 9:
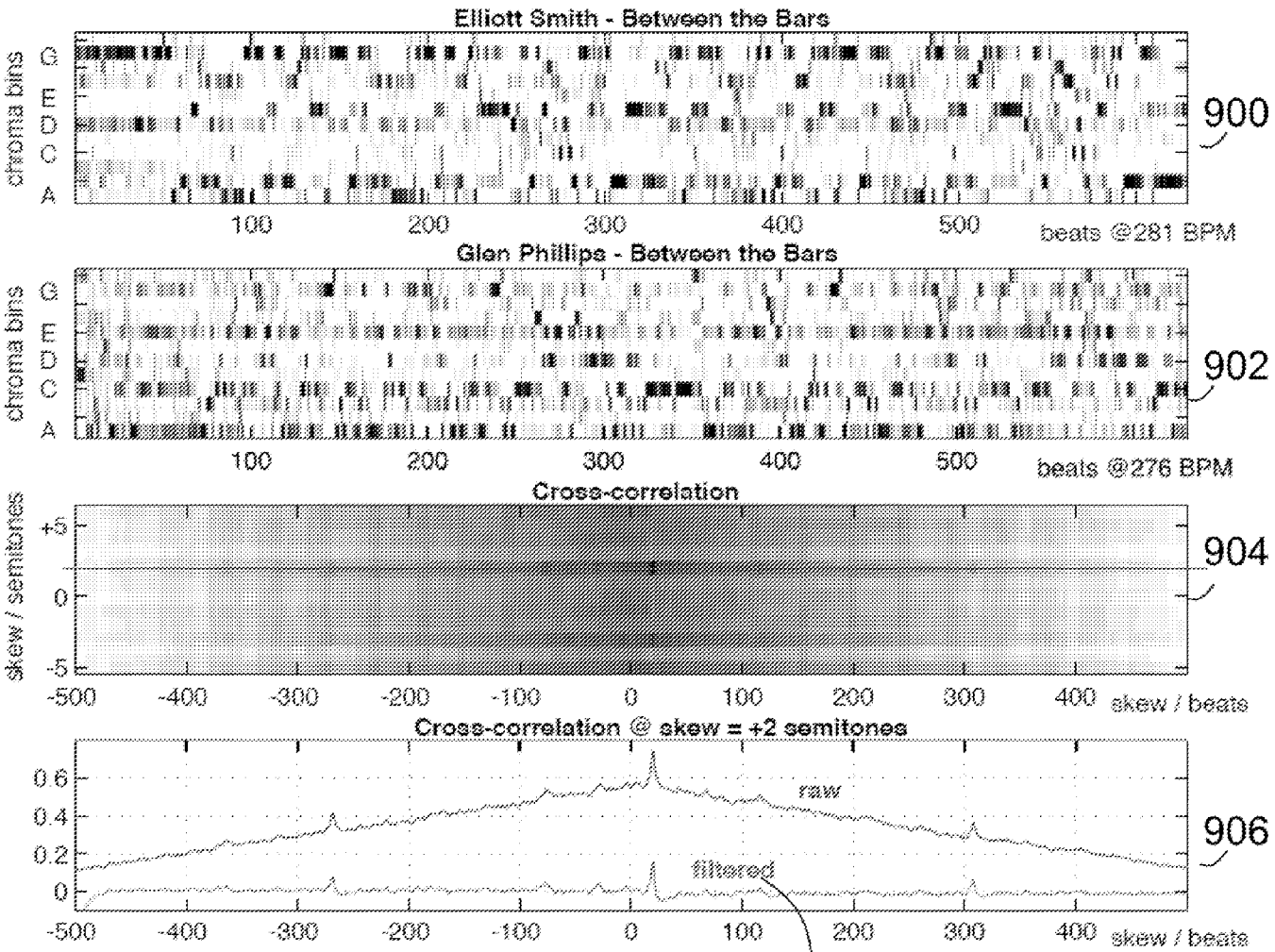
FIG. 9 is a diagram showing chroma bins for portions of two songs, a cross-on correlation of the songs, and a raw and filtered version of the cross-correlation in accordance with some embodiments.

FIG. 9, for example, shows stages in the comparison of the Elliott Smith track to a cover version recorded live by Glen Phillips. The top two panes 900 and 902 show the normalized, beat-synchronous instantaneous-frequency-based chroma feature matrices for both tracks (which have tempos about 2% different). The third pane 904 shows the raw cross-correlation for relative timings of −500 . . . 500 beats, and all 12 possible relative chroma skews. The bottom pane 906 shows the slice through this cross-correlation matrix for the most favorable relative tuning (Phillips transposed up 2 semitones) both before and after post-correlation high-pass filtering. As can be seen, filtering 908 removes the triangular baseline correlation but preserves the sharp peak at around +20 beats indicating the similarity between the versions.

Figure 10:
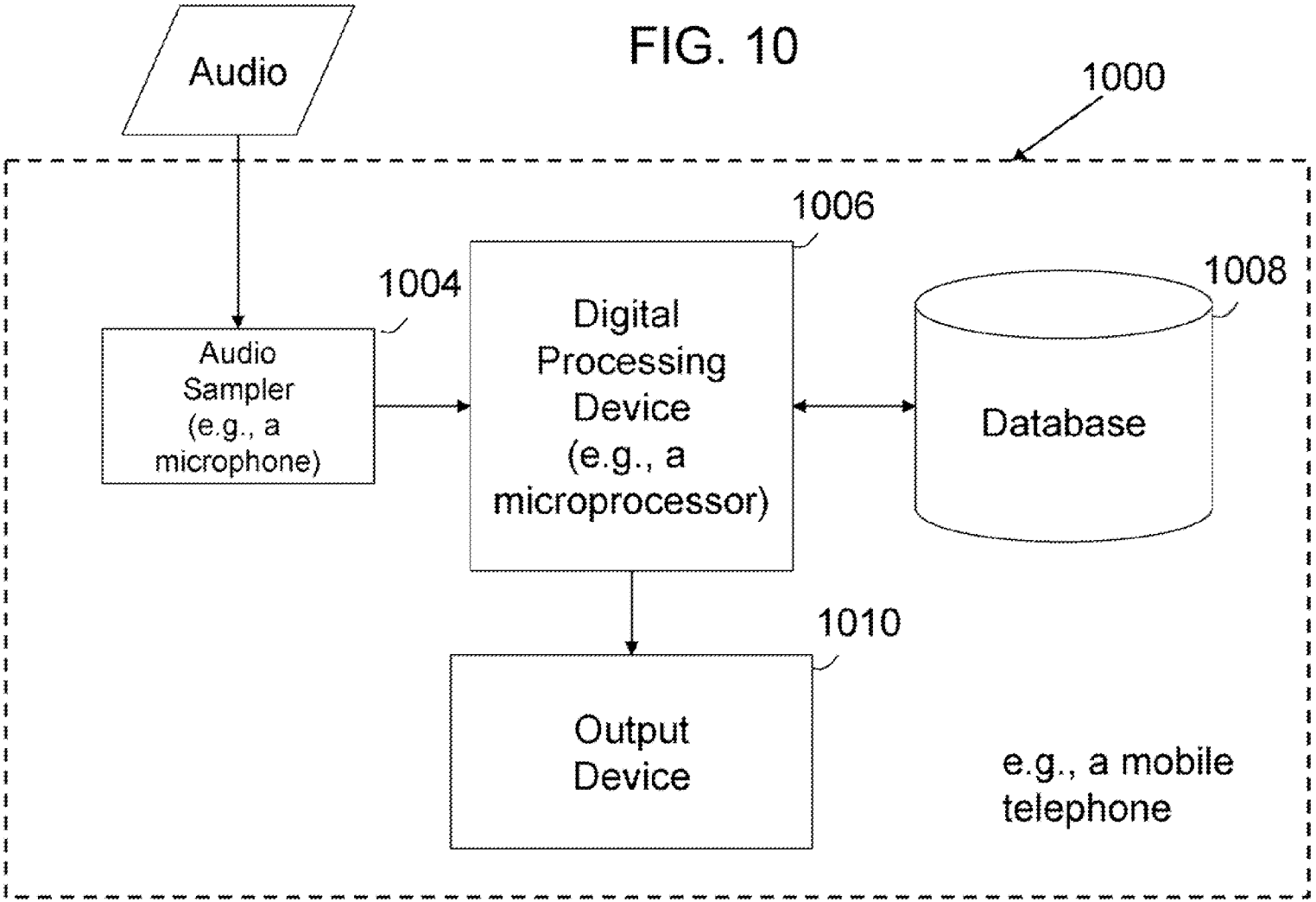
FIG. 10 is a diagram of hardware that can be used to implement mechanisms for identifying similar songs in accordance with some embodiments.

An example of hardware 1000 for implementing the mechanisms described above is illustrated in FIG. 10. As shown, an audio sampler 1004 can be provided which can receive audio and provide a format usable by digital processing device 1006. Audio sampler can be any suitable device for providing a song (or a portion of a song) to device 1006, such as a microphone, amplifier, and analog to digital converter, a media reader (such as a compact disc or digital video disc player), a coder-decoder (codec), a transcoder, etc. Digital processing device can be any suitable device for performing the functions described above, such as a microprocessor, a digital signal processor, a controller, a general purpose computer, a special purpose computer, a programmable logic device, etc. Database 1008 can be any suitable device for storing programs and/or data (e.g., such as beat-level descriptors, identifiers for songs, and any other suitable data). The data stored in database 1008 can include any suitable form of media, such as magnetic media, optical media, semiconductor media, etc., and can be implemented in memory, a disk drive, etc. Output device 1010 can be any suitable device or devices for outputting information and/or songs. For example, device 1010 can include a video display, an audio output, an interface to another device, etc.

The components of hardware 1000 can be included in any suitable devices. For example, these components can be included in a computer, a portable music player, a media center, mobile telephone, etc.

Although the invention has been described and illustrated in the foregoing illustrative embodiments, it is understood that the present disclosure has been made only by way of example, and that numerous changes in the details of implementation of the invention can be made without departing from the spirit and scope of the invention, which is only limited by the claims which follow. Features of the disclosed embodiments can be combined and rearranged in various ways.

What is claimed is:

1. A method for comparing songs, comprising:
receiving at least a portion of a song using a microphone in a mobile telephone; and
using a microprocessor in the mobile telephone:
identifying beat times for beats in the at least a portion of the song;
generating beat-level descriptors of the at least a portion of the song corresponding to the beats;
comparing the beat-level descriptors to other beat-level descriptors corresponding to a plurality of songs; and
identifying one of the plurality of songs on a display of the mobile telephone based on the comparing,
wherein identifying the beat times for the beats comprises forming an onset strength envelope for the at least a portion of the song, determining a primary tempo period estimate, identifying a beat in the beats, and back tracking from the beat to earlier-occurring beats.

2. A method for comparing songs, comprising:
receiving at least a portion of a song using a microphone in a mobile telephone; and
using a microprocessor in the mobile telephone:
identifying beat times for beats in the at least a portion of the song;
generating beat-level descriptors of the at least a portion of the song corresponding to the beats;
comparing the beat-level descriptors to other beat-level descriptors corresponding to a plurality of songs; and
identifying one of the plurality of songs on a display of the mobile telephone based on the comparing,
wherein generating beat-level descriptors comprises generating chroma bins for each beat of the portion of the song.

3. The method of claim 2, wherein the chroma bins are generated using a Fourier transform.

4. The method of claim 2, wherein the chroma bins span one octave, and further comprising mapping a plurality of octaves in the portion of the song to the same chroma bins.

5. A method for comparing songs, comprising:
receiving at least a portion of a song using a microphone in a mobile telephone; and
using a microprocessor in the mobile telephone:
identifying beat times for beats in the at least a portion of the song;
generating beat-level descriptors of the at least a portion of the song corresponding to the beats;
comparing the beat-level descriptors to other beat-level descriptors corresponding to a plurality of songs; and
identifying one of the plurality of songs on a display of the mobile telephone based on the comparing,
wherein comparing the beat-level descriptors to other beat-level descriptors comprises performing a cross-correlation on the beat-level descriptors.

6. The method of claim 5, wherein the cross-correlation comprises performing a Fourier transform on the beat-level descriptors.

7. A method for comparing songs, comprising:
receiving at least a portion of a song using a microphone in a mobile telephone; and
using a microprocessor in the mobile telephone:
identifying beat times for beats in the at least a portion of the song;
generating beat-level descriptors of the at least a portion of the song corresponding to the beats;
comparing the beat-level descriptors to other beat-level descriptors corresponding to a plurality of songs; and
identifying one of the plurality of songs on a display of the mobile telephone based on the comparing,
wherein comparing the beat-level descriptors to other beat-level descriptors comprises identifying boundaries in the beat-level descriptors and performing a nearest neighbor search.

8. The method of claim 7, wherein the nearest neighbor search is a Locality-Sensitive Hash.

9. A method for comparing songs, comprising:
receiving at least a portion of a song using a microphone in a mobile telephone;
using a microprocessor in the mobile telephone:
identifying beat times for beats in the at least a portion of the song;
generating beat-level descriptors of the at least a portion of the song corresponding to the beats;
comparing the beat-level descriptors to other beat-level descriptors corresponding to a plurality of songs; and
identifying one of the plurality of songs on a display of the mobile telephone based on the comparing; and
identifying at least one of the song and the plurality of songs as a cover song of another of the at least one of the song and the plurality of songs.

10. A device for comparing songs, comprising:
a mobile telephone including:
a microphone that receives at least a portion of a song;
a microprocessor that:
identifies beat times for beats in the at least a portion of the song;
generates beat-level descriptors of the at least a portion of the song corresponding to the beats; and
compares the beat-level descriptors to other beat-level descriptors corresponding to a plurality of songs; and
a display that identifies one of the plurality of songs based on the comparing,
wherein the microprocessor, in identifying the beat times for the beats, also forms an onset strength envelope for the at least a portion of the song, determines a primary tempo period estimate, identifies a beat in the beats, and back tracks from the beat to earlier-occurring beats.

11. A device for comparing songs, comprising:
a mobile telephone including:
a microphone that receives at least a portion of a song;

a microprocessor that:

identifies beat times for beats in the at least a portion of the song;

generates beat-level descriptors of the at least a portion of the song corresponding to the beats; and compares the beat-level descriptors to other beat-level descriptors corresponding to a plurality of songs; and a display that identifies one of the plurality of songs based on the comparing, wherein the microprocessor, in generating beat-level descriptors, also generates chroma bins for each beat of the portion of the song.

12. The device of claim 11, wherein the chroma bins are generated using a Fourier transform.

13. The device of claim 11, wherein the chroma bins span one octave, and the microprocessor also maps a plurality of octaves in the portion of the song to the same chroma bins.

14. A device for comparing songs, comprising:

a mobile telephone including:

a microphone that receives at least a portion of a song;

a microprocessor that:

identifies beat times for beats in the at least a portion of the song;

generates beat-level descriptors of the at least a portion of the song corresponding to the beats; and compares the beat-level descriptors to other beat-level descriptors corresponding to a plurality of songs; and a display that identifies one of the plurality of songs based on the comparing, wherein the microprocessor, in comparing the beat-level descriptors to other beat-level descriptors, also performs a cross-correlation on the beat-level descriptors.

15. The device of claim 14, wherein the microprocessor, in performing the cross-correlation, also performs a Fourier transform on the beat-level descriptors.

16. A device for comparing songs, comprising:

a mobile telephone including:

a microphone that receives at least a portion of a song;

a microprocessor that:

identifies beat times for beats in the at least a portion of the song;

generates beat-level descriptors of the at least a portion of the song corresponding to the beats; and compares the beat-level descriptors to other beat-level descriptors corresponding to a plurality of songs; and a display that identifies one of the plurality of songs based on the comparing, wherein the microprocessor, in comparing the beat-level descriptors to other beat-level descriptors, also identifies boundaries in the beat-level descriptors and performs a nearest neighbor search.

17. A device for comparing songs, comprising:

a mobile telephone including:

a microphone that receives at least a portion of a song;

a microprocessor that:

identifies beat times for beats in the at least a portion of the song;

generates beat-level descriptors of the at least a portion of the song corresponding to the beats; and compares the beat-level descriptors to other beat-level descriptors corresponding to a plurality of songs; and a display that identifies one of the plurality of songs based on the comparing, wherein the display also identifies at least one of the song and the plurality of songs as a cover song of another of the at least one of the song and the plurality of songs.

* * * * *

UNITED STATES PATENT AND TRADEMARK OFFICE

CERTIFICATE OF CORRECTION

PATENT NO. : 7,812,241 B2
APPLICATION NO. : 11/863014
DATED : October 12, 2010
INVENTOR(S) : Daniel P. W. Ellis It is certified that error appears in the above-identified patent and that said Letters Patent is hereby corrected as shown below:

Column 1, line 11, prior to "TECHNICAL FIELD," please insert the following paragraph:

-- STATEMENT REGARDING FEDERALLY SPONSORED RESEARCH OR DEVELOPMENT

This invention was made with government support under Grant No. IIS-0238301 awarded by the National Science Foundation. The government has certain rights in the invention. --

Signed and Sealed this
Thirty-first Day of January, 2012

David J. Kappos

David J. Kappos
*Director of the United States Patent and Trademark Office*